US009393808B2

(12) United States Patent
Ohishi et al.

(10) Patent No.: US 9,393,808 B2
(45) **Date of Patent: *Jul. 19, 2016**

(54) RECORDING METHOD

(71) Applicant: Brother Kogyo Kabushiki Kaisha, Nagoya-shi, Aichi-ken (JP)

(72) Inventors: Ayako Ohishi, Nagoya (JP); Mitsunori Maeda, Nagoya (JP); Kenjiro Imai, Toyohashi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 109 days.

This patent is subject to a terminal disclaimer.

(21) Appl. No.: 14/673,299

(22) Filed: Mar. 30, 2015

(65) Prior Publication Data

US 2015/0273884 A1 Oct. 1, 2015

(30) Foreign Application Priority Data

Mar. 31, 2014 (JP) ..... 2014-072044

(51) Int. Cl.

*B41J 2/15* (2006.01)
*B41J 11/00* (2006.01)
*B41J 2/01* (2006.01)

(52) U.S. Cl.

CPC ..... *B41J 11/0015* (2013.01); *B41J 2/01* (2013.01)

(58) Field of Classification Search

CPC ..... B41J 2202/20; B41J 2/155; B41J 2/2146; B41J 2/2114; B41J 2/2056; B41J 2/211; B41J 3/543; B41J 11/0015

See application file for complete search history.

(56) References Cited

U.S. PATENT DOCUMENTS

| | | | |
|---|---|---|---|
| 5,609,671 | A | 3/1997 | Nagasawa |
| 5,837,045 | A | 11/1998 | Johnson et al. |
| 7,922,805 | B2 | 4/2011 | Kowalski et al. |
| 8,016,404 | B2 | 9/2011 | Kato et al. |
| 8,858,695 | B2 | 10/2014 | Gu et al. |
| 8,916,625 | B2 | 12/2014 | Denda et al. |
| 2006/0201380 | A1 | 9/2006 | Kowalski et al. |
| 2007/0100023 | A1 | 5/2007 | Burns et al. |
| 2007/0100024 | A1 | 5/2007 | Gu et al. |
| 2008/0241398 | A1 | 10/2008 | Kato et al. |
| 2010/0227181 | A1 | 9/2010 | Kitamura |
| 2010/0261813 | A1 | 10/2010 | Bobsein et al. |

(Continued)

FOREIGN PATENT DOCUMENTS

| | | | |
|---|---|---|---|
| JP | H08-3498 | A | 1/1996 |
| JP | 2000-513396 | A | 10/2000 |

(Continued)

OTHER PUBLICATIONS

Co-pending U.S. Appl. No. 14/673,291, filed Mar. 30, 2015.

(Continued)

*Primary Examiner* — Lamson Nguyen
(74) *Attorney, Agent, or Firm* — Banner & Witcoff, Ltd.

(57) ABSTRACT

A recording method includes applying, to a recording medium, a treatment agent containing inorganic fine particles; discharging a bright pigment ink containing a bright pigment and water to a portion of the recording medium to which the treatment agent has been applied; and discharging a water-based pigment ink containing a pigment different from the bright pigment and water to the portion of the recording medium to which the bright pigment ink has been discharged.

20 Claims, 4 Drawing Sheets

(56) References Cited

U.S. PATENT DOCUMENTS

| | | | |
|---|---|---|---|
| 2011/0205288 | A1 | 8/2011 | Matsuyama et al. |
| 2012/0038702 | A1 | 2/2012 | Kagata et al. |
| 2013/0108841 | A1 | 5/2013 | Denda et al. |

FOREIGN PATENT DOCUMENTS

| | | | |
|---|---|---|---|
| JP | 2008-524400 | A | 7/2008 |
| JP | 2008-246821 | A | 10/2008 |
| JP | 2009-515007 | A | 4/2009 |
| JP | 2010-280830 | A | 12/2010 |
| JP | 2012-035591 | A | 2/2012 |
| JP | 2013-091761 | A | 5/2013 |
| WO | 9748769 | A1 | 12/1997 |
| WO | 2006-066132 | A2 | 6/2006 |

OTHER PUBLICATIONS

Co-pending U.S. Appl. No. 14/673,189, filed Mar. 30, 2015.
Co-pending U.S. Appl. No. 14/673,394, filed Mar. 30, 2015.
Jun. 22, 2015 (US) Non-Final office action U.S. Appl. No. 14/673,394.
Oct. 2, 2015—(US) Non-Final Office Action—U.S. Appl. No. 14/673,189.

RECORDING METHOD

CROSS REFERENCE TO RELATED APPLICATION

The present application claims priority from Japanese Patent Application No. 2014-072044 filed on Mar. 31, 2014, the disclosure of which is incorporated herein by reference in their entirety.

BACKGROUND OF THE INVENTION

1. Field of the Invention

The present invention relates to a recording method.

2. Description of the Related Art

In recent years, the demand is on the increase for the recorded matter on which an image having brightness (metallic luster feeling) is formed. As for a method for obtaining the recorded matter having the brightness, a method is known, in which a bright pigment ink is discharged onto a recording medium in accordance with the ink-jet system (Japanese Patent Application Laid-open No. 2012-35591 corresponding to United States Patent Application Publication No. 2012/0038702).

In the meantime, it is also demanded for a color image to obtain the brightness. For this purpose, it is investigated to obtain the brightness for all colors (full colors) by using color pigment inks in combination in addition to the bright pigment. However, if it is intended to obtain the brightness of the color image by using the bright pigment and the color pigments in combination, the presence of the bright pigment on the recording medium affects the color development of the color pigment. For example, if it is intended to record a brilliant yellow color by using a yellow pigment and a bright pigment, it is feared that a problem of color reproducibility may be caused to provide a color which resembles an ocher color and which is different from a color obtained when a yellow image is formed without using the bright pigment.

SUMMARY OF THE INVENTION

In view of the above, an object of the present teaching is to provide a recording method which provides excellent brightness and which is excellent in color reproducibility as well.

According to the present teaching, there is provided a recording method including applying, to a recording medium, a treatment agent containing inorganic fine particles; discharging a bright pigment ink containing a bright pigment and water to a portion of the recording medium to which the treatment agent has been applied; and discharging a water-based pigment ink containing a pigment different from the bright pigment and water to the portion of the recording medium to which the bright pigment ink has been discharged.

DESCRIPTION OF THE PREFERRED EMBODIMENTS

Figure 1A:
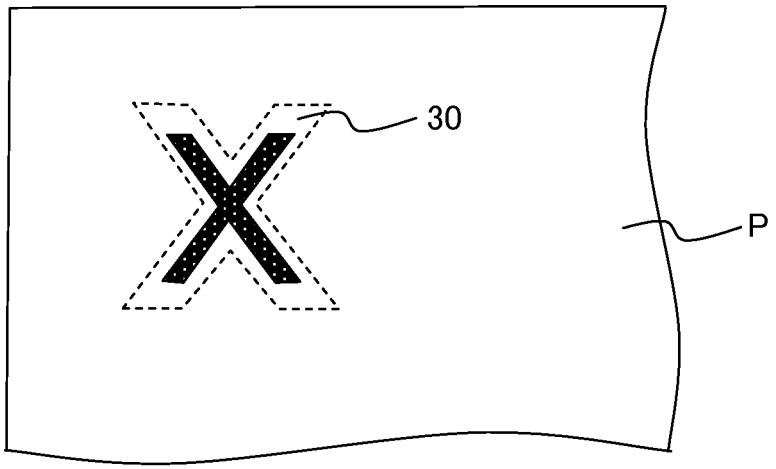
FIGS. 1A and 1B show examples of recording according to a recording method of the present teaching.

The recording medium, which is the objective of application of the recording method of the present teaching, may be a recording medium having high smoothness (good surface smooth) such as glossy paper or the like. However, the recording medium may be a recording medium having low smoothness (poor surface smooth) such as regular paper, matte paper or the like. According to the recording method of the present teaching, it is possible to obtain a recorded matter having excellent brightness in which the unevenness and the blurring are suppressed, even in the case of the use of a recording medium having low smoothness such as regular paper, matte paper or the like.

The recording method of the present teaching will be explained. The recording method of the present teaching includes a pretreatment step, a bright pigment ink discharge step, and a water-based pigment ink discharge step, and the respective steps are carried out in this order.

At first, the pretreatment step is explained. The pretreatment step is a step of applying a treatment agent to the recording medium (S1 in FIG. 2B). The treatment agent, which is used for the pretreatment step, includes inorganic fine particles.

The inorganic fine particles are exemplified, for example, by silica particles. The silica particles are exemplified, for example, by colloidal silica and fumed silica. The fumed silica is different from colloidal silica which is produced by the wet method, but the fumed silica is silica which is produced by the dry method (gas phase method). As for the inorganic fine particles of the present teaching, it is preferable to use fumed silica as compared with colloidal silica in relation to the following viewpoints. As described later on, the inorganic fine particles form a pretreatment layer on the recording medium. Water, which is contained, for example, in the bright pigment ink applied onto the pretreatment layer, is suppressed from remaining on the surface of the recording medium by the inorganic fine particles contained in the pretreatment layer. In general, colloidal silica has a shape which is approximate to a perfect sphere in the step of production in accordance with the wet method. On the other hand, the following fact is affirmed. That is, fumed silica, which is produced in accordance with the dry method (gas phase method), tends to form a chain-shaped secondary aggregate, and fumed silica has a specific surface area which is higher than that of colloidal silica as well. Therefore, it is considered that fumed silica has a high effect to suppress water contained, for example, in the bright pigment ink applied onto the pretreatment layer from remaining on the surface of the recording medium as compared with colloidal silica, and it is possible to suppress the unevenness and the blurring of the recorded matter.

It is preferable that the inorganic fine particles such as fumed silica or the like are those which are dispersible in water without using any dispersing agent, i.e., self-dispersible inorganic fine particles, owing to the fact that at least one of the anionic or cationic hydrophilic functional group and the salt thereof is introduced by the chemical bond directly or with any other group intervening therebetween on the surfaces of the inorganic fine particles. When the self-dispersible inorganic fine particles are used, it is thereby possible to solve the problem of increase in the viscosity of the treatment agent which would be otherwise caused by any macromolecular pigment dispersing agent. As for fumed silica described above, it is preferable to use anionic fumed silica.

It is preferable that the average particle size (average particle diameter) of the inorganic fine particles such as fumed silica or the like is not less than 50 nm and not more than 250 nm. It is more preferable that the average particle size of the inorganic fine particles is not more than 150 nm. The average particle size of the inorganic fine particles can be measured as, for example, the arithmetic mean diameter by using a dynamic light scattering type particle diameter distribution measuring apparatus "LB-550" produced by HORIBA, Ltd.

The inorganic fine particles such as fumed silica or the like may be prepared privately or independently. Alternatively, any commercially available product may be used therefor. The commercially available product of fumed silica is exemplified, for example, by "CAB-O-SPERSE (trade name) PG 001" and "CAB-O-SPERSE (trade name) PG 002" produced by Cabot Corporation.

The blending amount of the inorganic fine particles such as fumed silica or the like with respect to the total amount of the treatment agent is, for example, 3% by weight to 40% by weight, preferably 4% by weight to 30% by weight, and more preferably 8% by weight to 24% by weight.

The treatment agent may further contain a binder resin. Furthermore, in the ink set of the present teaching, the binder resin may be contained in the bright pigment ink described later on, in addition to the treatment agent or in place of the treatment agent.

As for the binder resin, any resin may be used without being specifically limited. However, it is preferable to use a urethane resin. Furthermore, it is preferable that the binder resin is contained in the treatment agent as a binder emulsion such as a urethane emulsion or the like. The "binder emulsion" is a system in which binder resin particles such as urethane resin particles are dispersed in water (hydrophilic solvent may be contained). The method for converting the binder resin into the binder emulsion is exemplified, for example, by a method in which a hydrophilic functional group such as carboxylate group, sulfonate group or the like is introduced into the binder resin such as the urethane resin or the like to cause self-emulsification, or emulsification is forcibly caused by using a surfactant. The surfactant is exemplified, for example, by nonionic surfactant, anionic surfactant, cationic surfactant, and amphoteric surfactant.

The average particle size of the binder resin particles contained in the binder emulsion such as the urethane emulsion or the like is preferably not more than 300 nm and more preferably not more than 150 nm. When the average particle size of the binder resin particles contained in the binder emulsion is not more than 300 nm, it is thereby possible to obtain a recorded matter which is more excellent in the color reproducibility and which is more excellent in the brightness. When the average particle size of the binder resin particles contained in the binder emulsion is not more than 150 nm, it is thereby possible to obtain a recorded matter which is much more excellent in the color reproducibility and which is much more excellent in the brightness. Furthermore, the average particle size of the binder resin particles contained in the binder emulsion is preferably not less than 1 nm and more preferably not less than 5 nm. The average particle size of the binder resin particles contained in the binder emulsion can be measured in the same manner as the average particle size of the inorganic fine particles described above.

It is preferable that the average particle size of the binder resin particles contained in the binder emulsion is smaller than the average particle size of the inorganic fine particles. As described later on, the binder resin and the inorganic fine particles form the pretreatment layer on the recording medium (see FIG. 3A). When the average particle size of the binder resin particles contained in the binder emulsion is smaller than the average particle size of the inorganic fine particles, then the gaps between the inorganic fine particles are filled with the binder resin particles, and thus it is possible to further smoothen the surface of the recording medium. Accordingly, it is possible to obtain the recorded matter which is more excellent in the brightness.

The binder resin such as the urethane resin or the like may be prepared privately or independently. Alternatively, any commercially available product may be used therefor. The commercially available product of the urethane resin is exemplified, for example, by "Ucoat (trade name) UWS-145" (average particle size: 20 nm), "Permalin (trade name) UA-150" (average particle size: 70 nm), and "Permalin (trade name) UA-368" (average particle size: 300 nm) produced by Sanyo Chemical Industries, Ltd., and "Superflex (trade name) series" produced by Dai-ichi Kogyo Seiyaku Co., Ltd.

The blending amount of the binder resin such as the urethane resin or the like with respect to the total amount of the treatment agent is, for example, 0.5% by weight to 20% by weight, preferably 1% by weight to 15% by weight, and more preferably 2% by weight to 8% by weight. Furthermore, when the binder resin is contained in the bright pigment ink described later on in addition to the treatment agent or in place of the treatment agent, the sum (T+I) of the blending amount (T: % by weight) of the binder resin with respect to the total amount of the treatment agent and the blending amount (I: % by weight) of the binder resin with respect to the total amount of the bright pigment ink is, for example, 0.5% by weight to 20% by weight, preferably 1% by weight to 15% by weight, and more preferably 2% by weight to 8% by weight.

It is preferable that the recording method of the present teaching fulfills the following conditions (Z1) and (Z2). It is more preferable that the recording method of the present teaching fulfills the following conditions (Z3) and (Z4).

$$2 \leq E/F \leq 5 \quad \text{(Z1)}$$

$$5 \leq E+F \leq 40 \quad \text{(Z1)}$$

$$2.5 \leq E/F \leq 4 \quad \text{(Z1)}$$

$$10 \leq E+F \leq 30 \quad \text{(Z1)}$$

E: blending amount (% by weight) of the inorganic fine particles contained in the treatment agent;

F: blending amount (% by weight) of the binder resin contained in the treatment agent.

If 2≤E/F is fulfilled, it is possible to obtain a recorded matter in which the unevenness and the blurring are more suppressed. If 2.5≤E/F is fulfilled, it is possible to obtain a recorded matter in which the unevenness and the blurring are much more suppressed. Furthermore, if E/F≤5 is fulfilled, it is possible to obtain a recorded matter in which the fixation performance of the treatment agent and the brightness are more excellent and the unevenness is more suppressed. If E/F≤4 is fulfilled, it is possible to obtain a recorded matter in which the fixation performance of the treatment agent and the brightness are much more excellent and the unevenness is much more suppressed. Moreover, if 5≤E+F is fulfilled, it is possible to obtain a recorded matter in which the brightness is more excellent. If 10≤E+F is fulfilled, it is possible to obtain a recorded matter in which the brightness is much more excellent. Moreover, if E+F≤40 is fulfilled, it is possible to obtain a recorded matter in which the fixation performance of the treatment agent and the brightness are more excellent and the unevenness is more suppressed. If E+F≤30 is fulfilled, it is possible to obtain a recorded matter in which the fixation performance of the treatment agent and the brightness are much more excellent and the unevenness is much more suppressed.

Furthermore, when the binder resin is contained in the bright pigment ink described later on in addition to the treatment agent or in place of the treatment agent, then it is preferable that the recording method of the present teaching fulfills the following conditions (Z5) and (Z6), and it is more preferable that the recording method of the present teaching fulfills the following conditions (Z7) and (Z8).

$$2 \leq E/F1 \leq 5 \quad (Z5)$$

$$5 \leq E+F1 \leq 40 \quad (Z6)$$

$$2.5 \leq E/F1 \leq 4 \quad (Z7)$$

$$10 \leq E+F1 \leq 30 \quad (Z8)$$

E: blending amount (% by weight) of the inorganic fine particles contained in the treatment agent;

F1: sum (T+I) of the blending amount (T: % by weight) of the binder resin contained in the treatment agent and the blending amount (I: % by weight) of the urethane resin contained in the bright pigment ink.

As described above, it is also allowable that the binder resin is contained in at least one of the treatment agent and the bright pigment ink. However, it is preferable that the binder resin is not contained in the bright pigment ink but the binder resin is contained in the treatment agent. As described later on, the binder resin and the inorganic fine particles form the pretreatment layer on the recording medium (see FIG. 3A). When the binder resin is contained in the treatment agent, then the bright pigment can be regularly aligned on the pretreatment layer after forming the pretreatment layer by applying the treatment agent, and it is possible to obtain the recorded matter which is more excellent in the brightness.

The treatment agent may further contain water. It is preferable that the water is ion exchange water or pure water. The blending amount of water with respect to the total amount of the treatment agent may be, for example, the balance of the other components.

The treatment agent may further contain a water-soluble organic solvent. Those having been hitherto known can be used as the water-soluble organic solvent. The water-soluble organic solvent is exemplified, for example, by polyhydric alcohol, polyhydric alcohol derivative, alcohol, amide, ketone, ketoalcohol (ketone alcohol), ether, nitrogen-containing solvent, sulfur-containing solvent, propylene carbonate, ethylene carbonate, and 1,3-dimethyl-2-imidazolidinone. The polyhydric alcohol is exemplified, for example, by glycerol, ethylene glycol, diethylene glycol, propylene glycol, butylene glycol, hexylene glycol, triethylene glycol, polyethylene glycol, dipropylene glycol, tripropylene glycol, polypropylene glycol, trimethylolpropane, 1,5-pentanediol, and 1,2,6-hexanetriol. The polyhydric alcohol derivative is exemplified, for example, by ethylene glycol methyl ether, ethylene glycol ethyl ether, ethylene glycol n-propyl ether, ethylene glycol n-butyl ether, diethylene glycol methyl ether, diethylene glycol ethyl ether, diethylene glycol n-propyl ether, diethylene glycol n-butyl ether, diethylene glycol n-hexyl ether, triethylene glycol methyl ether, triethylene glycol ethyl ether, triethylene glycol n-propyl ether, triethylene glycol n-butyl ether, propylene glycol methyl ether, propylene glycol ethyl ether, propylene glycol n-propyl ether, propylene glycol n-butyl ether, dipropylene glycol methyl ether, dipropylene glycol ethyl ether, dipropylene glycol n-propyl ether, dipropylene glycol n-butyl ether, tripropylene glycol methyl ether, tripropylene glycol ethyl ether, tripropylene glycol n-propyl ether, and tripropylene glycol n-butyl ether. The alcohol is exemplified, for example, by methyl alcohol, ethyl alcohol, n-propyl alcohol, isopropyl alcohol, n-butyl alcohol, sec-butyl alcohol, isobutyl alcohol, tert-butyl alcohol, and benzyl alcohol. The amide is exemplified, for example, by dimethylformamide and dimethylacetoamide. The ketone is exemplified, for example, by acetone. The ketoalcohol is exemplified, for example, by diacetone alcohol. The ether is exemplified, for example, by tetrahydrofuran and dioxane. The nitrogen-containing solvent is exemplified, for example, by pyrrolidone, 2-pyrrolidone, N-methyl-2-pyrrolidone, cyclohexylpyrrolidone, and triethanolamine. The sulfur-containing solvent is exemplified, for example, by thiodiethanol, thiodiglycol, thiodiglycerol, sulforan, and dimethylsulfoxide. The blending amount of the water-soluble organic solvent with respect to the total amount of the treatment agent is not specifically limited. One type of the water-soluble organic solvent may be used singly, or two or more types of the water-soluble organic solvents may be used in combination.

It is preferable that the treatment agent does not contain any colorant including, for example, pigments and dyes. When the treatment agent contains the colorant, it is preferable that the colorant is in such an amount that no influence is exerted on the recorded image. When the treatment agent contains the colorant, the blending amount of the colorant in the treatment agent is, for example, preferably not more than 1% by weight, more preferably not more than 0.1% by weight, and much more preferably not more than 0.01% by weight.

The treatment agent may further contain a conventionally known additive, if necessary. The additive is exemplified, for example, by surfactant, viscosity-adjusting agent, surface tension-adjusting agent, antioxidizing agent, and fungicide (antifungal agent). The viscosity-adjusting agent is exemplified, for example, by polyvinyl alcohol, cellulose, and water-soluble resin.

The treatment agent described above can be prepared, for example, such that the inorganic fine particles and optionally other additive components are mixed uniformly or homogeneously in accordance with any conventionally known method.

In the pretreatment step described above, the application of the treatment agent can be carried out, for example, by means of the discharge system, the stamp application, the brush application, or the roller application. The discharge system is such a system that the treatment agent is discharged and applied to the recording medium, for example, in accordance with the ink-jet system. As the names imply, the stamp application, the brush application, and the roller application reside in the systems in which the application is performed by using the stamp, the brush, and the roller respectively.

Figure 1B:
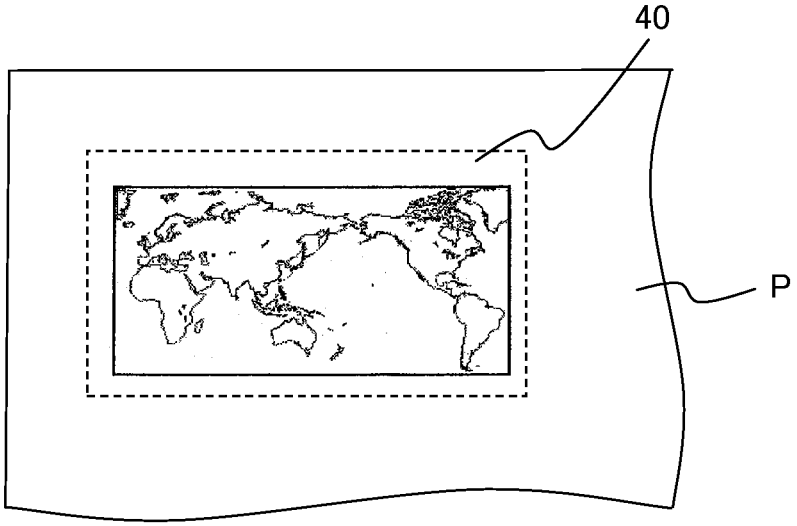

In the pretreatment step, the treatment agent may be applied to either the entire surface of the recording surface of the recording medium (for example, recording paper) or a part thereof. When the treatment agent is applied to the part, at least the recorded portion of the recording paper, which is subjected to the recording with the bright pigment ink and the water-based pigment ink, is the application portion. When the treatment agent is applied to the part, it is preferable that the size of the application portion is larger than the recorded portion. For example, as shown in FIG. 1A, when a letter (X) is recorded on the recording paper P, it is preferable to apply the treatment agent so that the application portion 30 is formed with a line width larger than the line width of the letter. Furthermore, as shown in FIG. 1B, when a pattern is recorded on the recording paper P, it is preferable to apply the treatment agent so that the application portion 40, which is larger than the pattern, is formed.

In the next place, the bright pigment ink discharge step is explained. The bright pigment ink discharge step is the step of discharging the bright pigment ink onto the recording medium in accordance with the ink-jet system (S2 in FIG. 2B). The bright pigment ink, which is used for the bright pigment ink discharge step, contains the bright pigment and water.

The bright pigment is not specifically limited. The bright pigment is exemplified, for example, by metal particles and pearl pigment. The metal particles are exemplified, for example, by particles of silver, aluminum, gold, platinum, nickel, chromium, stannum (tin), zinc, indium, titanium, and copper. The pearl pigment is exemplified, for example, by pigments having the pearl luster or the interference luster including, for example, titanium dioxide-coated mica, fish scales foil, and bismuth trichloride. One type of the bright pigment may be used singly, or two or more types of the bright pigments may be used in combination. Among them, it is preferable to use silver particles and aluminum particles, and it is especially preferable to use silver particles.

The average particle size of the bright pigment is preferably 1 nm to 100 nm and more preferably 5 nm to 50 nm. When the average particle size of the bright pigment is within the range described above, then it is possible to satisfactorily maintain the dispersion state of the bright pigment in the bright pigment ink, and it is possible to obtain the recorded matter which is more excellent in the color reproducibility and the brightness. The average particle size of the bright pigment can be measured in the same manner as the average particle size of the inorganic fine particles.

Any commercially available product may be used as the bright pigment. The commercially available product is exemplified, for example, by "Silver Nanocolloid H-1 (silver concentration: 20%, water dispersion liquid)" (average particle size: 20 nm), "Silver Nanocolloid A-1 (silver concentration: 10%, water dispersion liquid)", and "Silver Nanocolloid A-2 (silver concentration: 10%, water dispersion liquid)" produced by Mitsubishi Materials Electronic Chemicals Co., Ltd.; "Product Number 730785 (silver concentration: 0.1%, buffer dispersion)", "Product Number 730793 (silver concentration: 0.1%, buffer dispersion)", "Product Number 730807 (silver concentration: 0.1%, buffer dispersion)", "Product Number 730815 (silver concentration: 0.1%, buffer dispersion)", and "Product Number 730777 (silver concentration: 0.1%, buffer dispersion)" produced by SIGMA-ALDRICH; "PChem/DOWA Nanoink (silver concentration: 20%, water dispersion)" produced by DOWA Electronics; "Silver Nanoink (silver concentration: 20%, water dispersion)" produced by Mitsubishi Paper Mills Limited; and "Ag—Cu Nanoparticle Paste NAGNCU15-K01" produced by Daiken Chemical Co., Ltd.

The blending amount of the bright pigment (bright pigment ratio) with respect to the total amount of the bright pigment ink is, for example, 0.5% by weight to 20% by weight, preferably not more than 12% by weight, and more preferably not more than 10% by weight. When the bright pigment ratio is not more than 12% by weight, it is possible to obtain the ink set which is more excellent in the color reproducibility.

It is preferable that the water is ion exchange water or pure water. The blending amount of water (water ratio) with respect to the total amount of the bright pigment ink is, for example, 10% by weight to 80% by weight, and preferably 40% by weight to 80% by weight. The water ratio may be, for example, the balance of the other components.

The bright pigment ink may contain the binder resin. However, when the treatment agent contains the binder resin, it is also allowable that the bright pigment ink does not contain the binder resin. The type and the preferred blending amount of the binder resin are as explained in relation to the treatment agent described above.

It is preferable that the bright pigment ink further contains a water-soluble organic solvent. The water-soluble organic solvent is exemplified, for example, by a humectant (moistening agent) which prevents the bright pigment ink from being dried at the nozzle forward end portion of the ink-jet head and a penetrant (permeating agent) which adjusts the drying speed on the recording medium.

The humectant described above is not specifically limited. The humectant is exemplified, for example, by lower alcohols such as methyl alcohol, ethyl alcohol, n-propyl alcohol, isopropyl alcohol, n-butyl alcohol, sec-butyl alcohol, and tert-butyl alcohol; amides such as dimethylformamide and dimethylacetamide; ketones such as acetone; ketoalcohols (ketone alcohols) such as diacetone alcohol; ethers such as tetrahydrofuran and dioxane; polyethers such as polyalkylene glycols; polyhydric alcohols such as alkylene glycols, glycerol, trimethylolpropane, and trimethylolethane; 2-pyrrolidone; N-methyl-2-pyrrolidone; and 1,3-dimethyl-2-imidazolidinone. The polyalkylene glycol is exemplified, for example, by polyethylene glycol and polypropylene glycol. The alkylene glycol is exemplified, for example, by ethylene glycol, propylene glycol, butylene glycol, diethylene glycol, triethylene glycol, dipropylene glycol, tripropylene glycol, thiodiglycol, and hexylene glycol. One type of the humectant as described above may be used singly, or two or more types of the humectants as described above may be used in combination. Among them, it is preferable to use polyhydric alcohol such as alkylene glycol and glycerol.

The blending amount of the humectant with respect to the total amount of the bright pigment ink is, for example, 0% by weight to 95% by weight, preferably 5% by weight to 80% by weight, and more preferably 5% by weight to 50% by weight.

The penetrant is exemplified, for example, by glycol ether. The glycol ether is exemplified, for example, by ethylene glycol methyl ether, ethylene glycol ethyl ether, ethylene glycol n-propyl ether, diethylene glycol methyl ether, diethylene glycol ethyl ether, diethylene glycol n-propyl ether, diethylene glycol n-butyl ether, diethylene glycol n-hexyl ether, triethylene glycol methyl ether, triethylene glycol ethyl ether, triethylene glycol n-propyl ether, triethylene glycol n-butyl ether, propylene glycol methyl ether, propylene glycol ethyl ether, propylene glycol n-propyl ether, propylene glycol n-butyl ether, dipropylene glycol methyl ether, dipropylene glycol ethyl ether, dipropylene glycol n-propyl ether, dipropylene glycol n-butyl ether, tripropylene glycol methyl ether, tripropylene glycol ethyl ether, tripropylene glycol n-propyl ether, and tripropylene glycol n-butyl ether. One type of the penetrant as described above may be used singly, or two or more types of the penetrants as described above may be used in combination.

The blending amount of the penetrant with respect to the total amount of the bright pigment ink is, for example, 0% by weight to 20% by weight, preferably 0.1% by weight to 15% by weight, and more preferably 0.5% by weight to 10% by weight.

The bright pigment ink may further contain conventionally known additives, if necessary. The additive includes, for example, surfactants, pH-adjusting agents, viscosity-adjusting agents, surface tension-adjusting agents, and fungicides (antifungal agents). The viscosity-adjusting agent includes, for example, polyvinyl alcohol, cellulose, and water-soluble resin.

The bright pigment ink described above can be prepared, for example, such that the bright pigment, water, and optionally other additive components are mixed uniformly or homogeneously in accordance with any conventionally known method, and undissolved matters are removed by means of a filter or the like.

In the next place, the water-based pigment ink discharge step is explained. The water-based pigment ink discharge step is the step in which the water-based pigment ink is discharged onto the recording medium in accordance with the ink-jet system (S3 in FIG. 2B).

The water-based pigment ink, which is used in the water-based pigment ink discharge step, contains the pigment different from the bright pigment and water. The pigment is the colorant, which includes at least one of the chromatic color pigment and the black-based pigment which is achromatic color except for the white, including the black and the gray. (hereinafter, the pigment is referred to as "chromatic color pigment or the like").

The chromatic color pigment or the like is exemplified, for example, by carbon black, inorganic pigment, and organic pigment. The carbon black is exemplified, for example, by furnace black, lamp black, acetylene black, and channel black. The inorganic pigment can be exemplified, for example, by titanium oxide, iron oxide-based inorganic pigment, and carbon black-based inorganic pigment. The organic pigment is exemplified, for example, by azo-pigments such as azo lake, insoluble azo-pigment, condensed azo-pigment, chelate azo-pigment and the like; polycyclic pigments such as phthalocyanine pigment, perylene and perynon pigments, anthraquinone pigment, quinacridone pigment, dioxadine pigment, thioindigo pigment, isoindolinone pigment, quinophthalone pigment and the like; dye lake pigments such as basic dye type lake pigment, acid dye type lake pigment and the like; nitro pigments; nitroso pigments; and aniline black daylight fluorescent pigment. Any other pigment is also usable provided that the pigment is dispersible in the water phase. Specified examples of the pigments as described above include, for example, C. I. Pigment Blacks 1, 6, and 7; C. I. Pigment Yellows 1, 2, 3, 12, 13, 14, 15, 16, 17, 55, 78, 150, 151, 154, 180, 185, and 194; C. I. Pigment Oranges 31 and 43; C. I. Pigment Reds 2, 3, 5, 6, 7, 12, 15, 16, 48, 48:1, 53:1, 57, 57:1, 112, 122, 123, 139, 144, 146, 149, 166, 168, 175, 176, 177, 178, 184, 185, 190, 202, 221, 222, 224, and 238; C. I. Pigment Violet 196; C. I. Pigment Blues 1, 2, 3, 15, 15:1, 15:2, 15:3, 15:4, 16, 22, and 60; and C. I. Pigment Greens 7 and 36.

The chromatic color pigment or the like may be any self-dispersible pigment. The self-dispersible pigment is dispersible in water without using any dispersing agent, for example, owing to the fact that at least one of the hydrophilic functional group and the salt thereof including, for example, carbonyl group, hydroxyl group, carboxylic acid group, sulfonic acid group, and phosphoric acid group is introduced into the pigment particles by means of the chemical bond directly or with any other group intervening therebetween. Those usable as the self-dispersible pigment include, for example, those in which the pigment is treated or processed in accordance with any method described, for example, in Japanese Patent Application Laid-open No. 8-3498 corresponding to U.S. Pat. No. 5,609,671, Japanese Patent Application Laid-open No. 2000-513396 (PCT) corresponding to U.S. Pat. No. 5,837,045, Japanese Patent Application Laid-open No. 2008-524400 (PCT) corresponding to United States Patent Application Publication No. 2006/0201380, and Japanese Patent Application Laid-open No. 2009-515007 (PCT) corresponding to United States Patent Application Publication Nos. 2007/0100023 and 2007/0100024. The pigment, which is suitable to perform the treatment as described above, includes, for example, carbon blacks such as "MA8" and "MA100" produced by Mitsubishi Chemical Corporation, and "Color Black FW200" produced by Degussa. For example, any commercially available product may be used for the self-dispersible pigment. The commercially available product includes, for example, "CAB-O-JET (trade name) 200", "CAB-O-JET (trade name) 250C", "CAB-O-JET (trade name) 260M", "CAB-O-JET (trade name) 270Y", "CAB-O-JET (trade name) 300", "CAB-O-JET (trade name) 400", "CAB-O-JET (trade name) 450C", "CAB-O-JET (trade name) 465M", and "CAB-O-JET (trade name) 470Y" produced by Cabot Corporation; and "BONJET (trade name) BLACK CW-2" and "BONJET (trade name) BLACK CW-3" produced by Orient Chemical Industries, Ltd.

The average particle size of the chromatic color pigment or the like is preferably 100 nm to 150 nm. When the average particle size of the chromatic color pigment or the like is within the range as described above, then it is possible to satisfactorily maintain the dispersion state of the chromatic color pigment or the like in the water-based pigment ink, and it is possible to obtain the recorded matter which is more excellent in the color reproducibility and the brightness. The average particle size of the bright pigment can be measured in the same manner as the average particle size of the inorganic fine particles described above.

It is preferable that the average particle size of the chromatic color pigment or the like is larger than the average particle size of the bright pigment. As described later on, in the present teaching, the water-based pigment ink is discharged onto the bright pigment ink layer on the recording medium (see FIG. 3B). In this procedure, when the average particle size of the chromatic color pigment or the like is larger than the average particle size of the bright pigment, such a situation is not caused that the bright pigment adheres to the surface of the chromatic color pigment or the like to deteriorate the color development performance.

The solid content blending amount of the pigment (pigment ratio) with respect to the total amount of the water-based pigment ink is not specifically limited, which is, for example, 0.5% by weight to 20% by weight, preferably 1% by weight to 15% by weight, and more preferably 2% by weight to 10% by weight.

The type and the blending amount of water in the water-based pigment ink are the same as or equivalent to the type and the blending amount of water in the bright pigment ink described above.

It is preferable that the water-based pigment ink further contains a water-soluble organic solvent. The type and the blending amount of the water-soluble organic solvent in the water-based pigment ink are the same as or equivalent to the type and the blending amount of the water-soluble organic solvent in the bright pigment ink described above.

The water-soluble pigment ink may further contain a conventionally known additive, if necessary. The type of the additive is the same as or equivalent to the type of the additive in the bright pigment ink described above.

The water-soluble pigment ink described above can be prepared, for example, such that the pigment, water, and optionally other additive components are mixed uniformly or homogeneously in accordance with any conventionally known method, and undissolved matters are removed by means of a filter or the like.

Figure 2A:
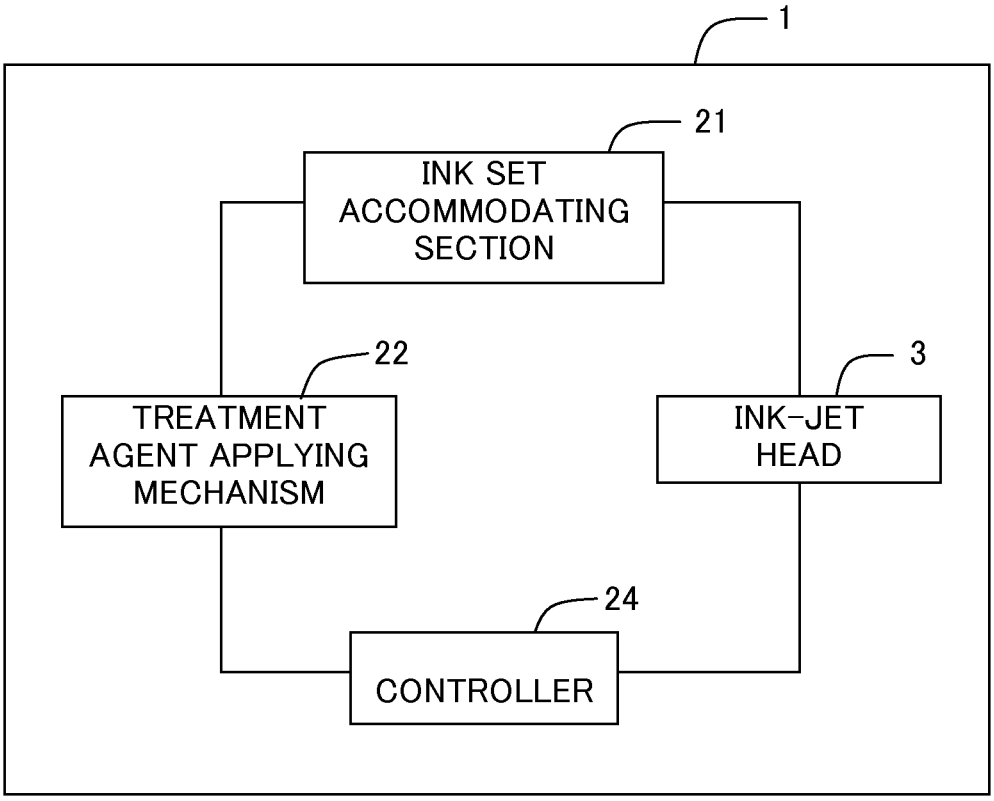
FIG. 2A shows a functional block diagram illustrating an exemplary arrangement of an ink-jet recording apparatus of the present teaching.
Figure 2B:
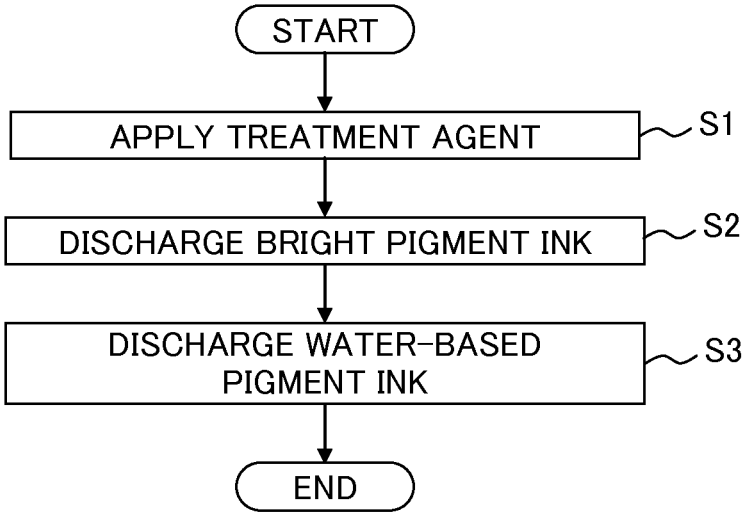
FIG. 2B shows a flow chart illustrating an example of the recording method of the present teaching.

With reference to FIGS. 2 and 3, the recording method and the ink-jet recording apparatus of the present teaching will be explained as exemplified by examples. FIG. 2A shows a functional block diagram illustrating an exemplary arrangement of the ink-jet recording apparatus of the present teaching. FIG. 2B shows a flow chart illustrating an example of the recording method of the present teaching. As shown in FIG. 2A, the ink-jet recording apparatus 1 of the present teaching includes, as main constitutive members, an ink set accommodating section 21, a treatment agent applying mechanism 22, an ink discharge mechanism (ink-jet head) 3, and a control mechanism (controller) 24. The ink set accommodating section 21 accommodates the treatment agent, the bright pigment ink, and the water-based pigment ink, from which the treatment agent, the bright pigment ink, and the water-based pigment ink are supplied to the treatment agent applying mechanism 22 and the ink discharge mechanism 3. The application of the treatment agent applied by the treatment agent applying mechanism 22 and the discharge of the bright pigment ink and the water-based pigment ink discharged by the ink discharge mechanism 3 are controlled by the control mechanism 24. Details of the ink-jet recording apparatus of the present teaching will be described later on.

Figure 3A:
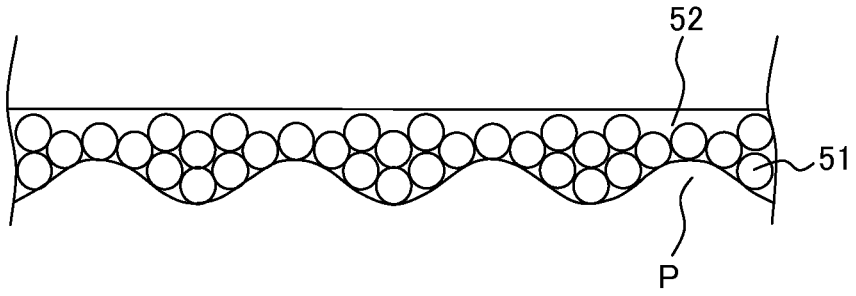
FIGS. 3A to 3C show steps illustrating an example of the recording method of the present teaching.

FIG. 3 shows an estimated mechanism for improving the color reproducibility together with an example of the recording method of the present teaching. At first, the treatment agent (inorganic fine particles 51 and binder resin 52) is applied by the treatment agent applying mechanism 22 to a recording-scheduled portion of the recording surface of the recording medium (for example, recording paper) P, and thus a pretreatment layer is formed (S1 in FIG. 2B). As shown in FIG. 3A, the inorganic fine particles 51 and the binder resin 52, which are contained in the treatment agent, are applied to protrusions and recesses formed by the fiber for constructing the recording paper P. The paper surface is smoothened by applying the binder resin 52 and the inorganic fine particles 21 onto the recording paper P. Furthermore, when the inorganic fine particles 51 are applied, then the water, which is contained, for example, in the bright pigment ink applied in the step described later on, is facilitated to permeate into the paper surface, for example, through the surfaces of the inorganic fine particles 51, and the water is retained in the gaps between the inorganic fine particles 51. Therefore, it is possible to suppress the water from remaining on the surface of the recording paper P. It is preferable that the thickness of the pretreatment layer is 0.1 μm to 20 μm. When the thickness of the pretreatment layer is not less than 0.1 μm, it is facilitated to permeate and retain the water, which is contained, for example, in bright pigment ink. When the thickness of the pretreatment layer is not more than 20 μm, the pretreatment layer is hard to be cracked even when the recording paper P is bent.

Figure 3B:
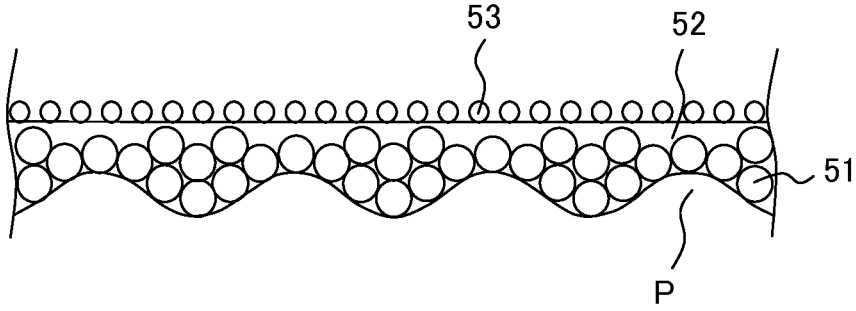
Figure 3C:
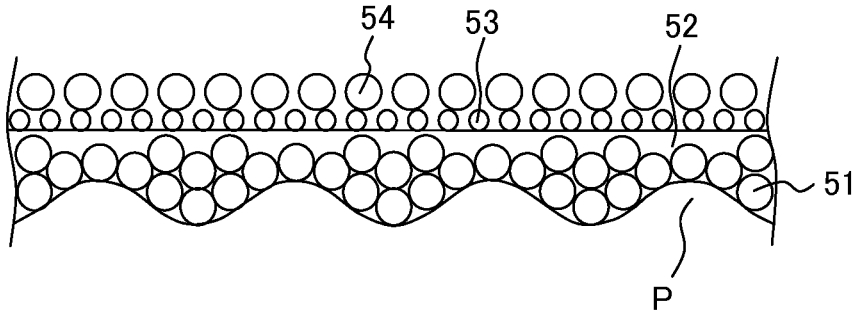

Subsequently, the bright pigment ink is discharged to the recording-scheduled portion by means of the ink discharge mechanism 3, and thus a bright pigment ink layer is formed (S2 in FIG. 2B). As shown in FIG. 3B, the surface of the recording paper P, which is provided after applying the treatment agent, is smoothened by the inorganic fine particles 51 and the binder resin 52. Accordingly, the bright pigment 53, which is applied thereon, is regularly aligned in the paper surface direction on the recording paper P, and thus it is possible to provide the excellent brightness. Subsequently, the water-based pigment ink is discharged onto the bright pigment ink layer by means of the ink discharge mechanism 3 (S3 in FIG. 2B). If the bright pigment 53 is applied over the pigment 54 which causes the appearance of protrusions and recesses, it is feared that the arrangement of the bright pigment may become non-uniform, and the brightness may be deteriorated. However, in the present teaching, as shown in FIG. 3C, the water-based pigment ink is discharged after the discharge of the bright pigment ink. Accordingly, the color reproducibility is satisfactory, and the brightness can be obtained for all of the colors (full colors). Furthermore, when the particle size of the pigment 54 is larger than the particle size of the bright pigment 53, such a situation is not caused that the bright pigment 53 adheres to the surface of the pigment 54 to deteriorate the color development performance. However, this mechanism described above is merely estimated, and the present teaching is not limited to and restricted by this mechanism.

In the example of the recording method of the present teaching shown in FIG. 3, the treatment agent contains the binder resin. However, the present teaching is not limited thereto. In the present teaching, it is also allowable that the binder resin is contained in the bright pigment ink in addition to the treatment agent or in place of the treatment agent. Furthermore, in the present teaching, it is also allowable that the treatment agent and the bright pigment ink do not contain the binder resin. In this case, the pretreatment layer does not contain the binder resin, but it is possible to suppress water from remaining on the surface of the recording medium by means of the inorganic fine particles in the treatment agent, and it is possible to suppress the unevenness and the blurring of the recorded matter. In particular, when the recording medium having the high smoothness such as the glossy paper or the like is used as the recording medium, it is possible to obtain the printed matter having the color reproducibility and the brightness even when the treatment agent and the bright pigment ink do not contain the binder resin.

In the recording method of the present teaching, a first period ($T_1$) and a second period ($T_2$) are not particularly limited, the first period ($T_1$) being a period elapsed after the treatment agent is applied on the recording medium until the bright pigment ink is discharged on the recording medium, the second period ($T_2$) being a period elapsed after the bright pigment ink is discharged on the recording medium until the water-based pigment ink is discharged on the recording medium. However, it is preferred that the first period ($T_1$) be longer than the second period ($T_2$). The control mechanism 24 depicted in FIG. 2A may control the treatment agent applying mechanism 22 and the ink discharge mechanism 3 to make the first period ($T_1$) longer than the second period ($T_2$). Making the first period ($T_1$) longer than the second period ($T_2$) allows the pretreatment layer, which is formed on the recording medium by the application of the treatment agent, to be dried sufficiently. The pretreatment layer may be dried, for example, naturally or by hot air.

In the recording method of the present teaching, as described above, the pretreatment step, the bright pigment ink discharge step, and the water-based pigment ink discharge step are carried out in this order. Accordingly, the pigment, which is the colorant, is applied onto the ink layer of the bright pigment ink, and it is possible to enhance the brightness and the color reproducibility of the printed matter. Therefore, in view of the fact that the brightness and the color reproducibility of the printed matter are enhance, it is preferable that the bright pigment is contained in only the bright pigment ink and the bright pigment is not contained in the water-based pigment ink, and it is preferable that the pigment as the colorant is contained in only the water-based pigment ink and the pigment as the colorant is not contained in the bright pigment ink. If the water-based pigment ink contains the bright pigment, it is preferable that the blending amount is of such an extent that the brightness and the color reproducibility of the printed matter are not affected. The blending amount is, for example, not more than 1% by weight, preferably not more than 0.1% by weight, and more preferably not more than 0.01% by weight. Similarly, if the bright pigment ink contains the pigment as the colorant, it is preferable that the blending amount is of such an extent that the brightness and the color reproducibility of the printed matter are not affected. The blending amount is, for example, not more than 1% by weight, preferably not more than 0.01% by weight, and more preferably not more than 0.01% by weight.

In the recording method of the present teaching, it is preferable that the following conditions (X) and (Y) are fulfilled.

$$1.0 \leq (A \times B)/100 \leq 11 \quad \text{(X)}$$

$$(C \times D)/100 \leq 5.5 \quad \text{(Y)}$$

A: blending amount (% by weight) of the bright pigment contained in the bright pigment ink;

B: Duty (%) of the bright pigment ink upon discharge of the bright pigment ink;

C: blending amount (% by weight) of the pigment contained in the water-based pigment ink;

D: Duty (%) of the water-based pigment ink upon discharge of the water-based pigment ink.

When $1.0 \leq (A \times B)/100 \leq 11$ is given, it is possible to obtain a recorded matter which is more excellent in the brightness and the color reproducibility. Furthermore, when $(C \times D)/100 \leq 5.5$ is given, it is possible to obtain a recorded matter which is more excellent in the color reproducibility.

"Duty" described above is defined as follows.

Duty (%)=real recording dot number/(longitudinal resolution×lateral resolution)×100

Real recording dot number: real recording dot number per unit area;

Longitudinal resolution: longitudinal resolution per unit area;

Lateral resolution: lateral resolution per unit area.

In the recording method of the present teaching, it is more preferable to fulfill the following conditions (X1) and (Y1).

$$2.5 \leq (A \times B)/100 \leq 7.5 \quad \text{(X1)}$$

$$(C \times D)/100 \leq 4.0 \quad \text{(Y1)}$$

A: blending amount (% by weight) of the bright pigment contained in the bright pigment ink;

B: Duty (%) of the bright pigment ink upon discharge of the bright pigment ink;

C: blending amount (% by weight) of the pigment contained in the water-based pigment ink;

D: Duty (%) of the water-based pigment ink upon discharge of the water-based pigment ink.

When $2.5 \leq (A \times B)/100 \leq 7.5$ is given, it is possible to obtain a recorded matter which is much more excellent in the brightness and the color reproducibility. Furthermore, when $(C \times D)/100 \leq 4.0$ is given, it is possible to obtain a recorded matter which is much more excellent in the color reproducibility.

In the recording method of the present teaching, the situation, in which all of the conditions (X1), (Y1), (Z3), and (Z4) are fulfilled, is especially preferred, because it is possible to obtain a recorded matter in which the fixation performance is especially excellent, the brightness and the color reproducibility are especially excellent, and the unevenness and the blurring are especially suppressed.

In the next place, the ink set of the present teaching resides in an ink set which is usable for the recording method of the present teaching, including a treatment agent, a bright pigment ink, and a water-based pigment ink, wherein the treatment agent contains inorganic fine particles, the bright pigment ink contains a bright pigment and water, and the water-based pigment ink contains a pigment different from the bright pigment and water. In the ink set of the present teaching, for example, the types and the blending amounts of the inorganic fine particles, the bright pigment, water, and the pigment, may be the same as or equivalent to those of the recording method of the present teaching.

In the next place, the ink-jet recording apparatus of the present teaching resides in an ink-jet recording apparatus including an ink set accommodating section, a treatment agent applying mechanism, an ink discharge mechanism, and a control mechanism, wherein the ink set of the present teaching is accommodated in the ink set accommodating section, the treatment agent, which constitutes the ink set, is applied to a recording medium by the treatment agent applying mechanism, the bright pigment ink and the water-based pigment ink for constructing the ink set are discharged to the recording medium by the ink discharge mechanism, and control is performed by the control mechanism so that the application of the treatment agent, the discharge of the bright pigment ink, and the discharge of the water-based pigment inks are performed in this order.

The ink-jet recording method of the present teaching can be carried out, for example, by using the ink-jet recording apparatus of the present teaching. The recording includes, for example, the letter (character) printing, the image printing, and the printing (print or presswork).

Figure 4:
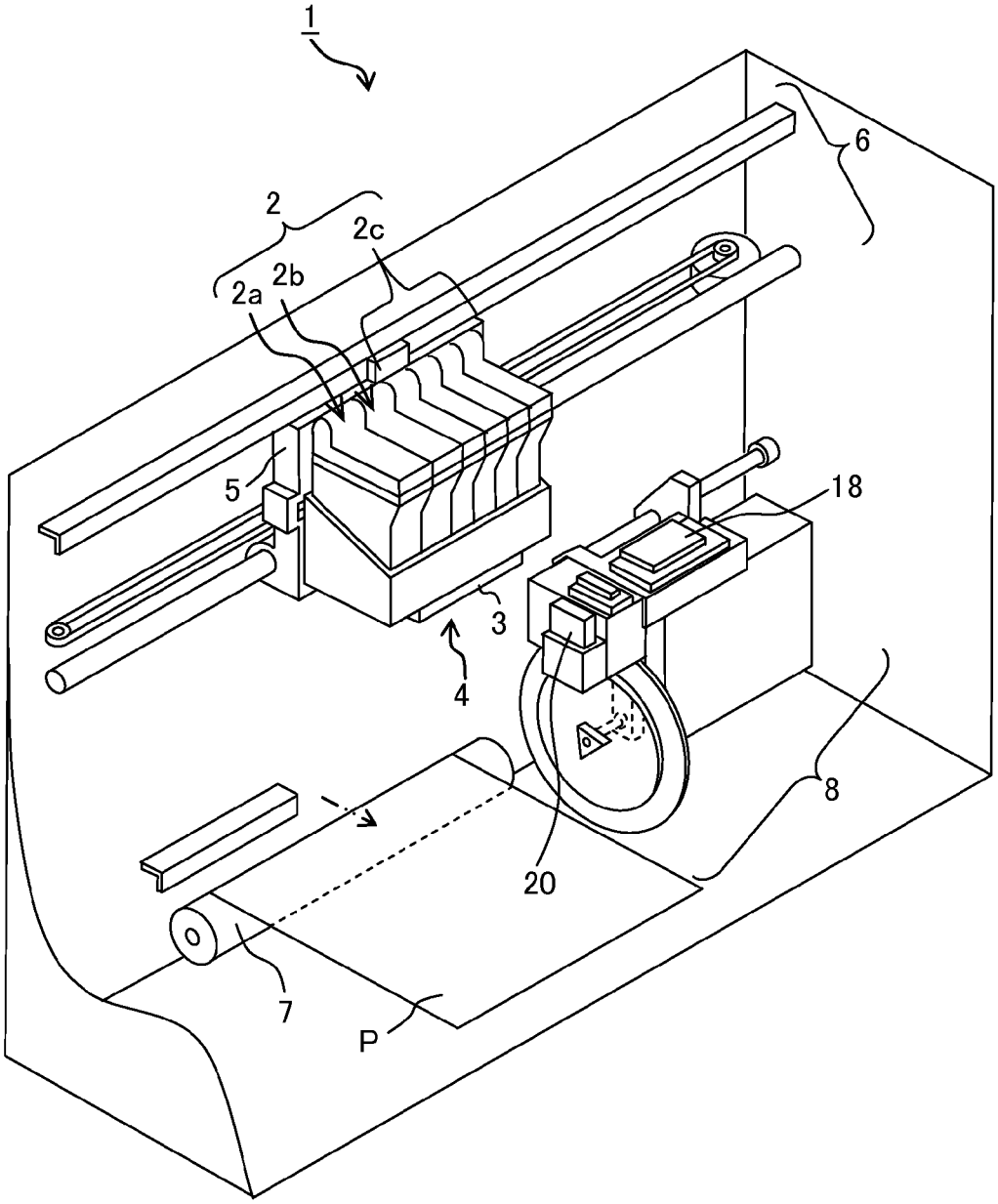
FIG. 4 shows a schematic perspective view illustrating an example of construction of the ink-jet recording apparatus of the present teaching.

FIG. 4 shows an exemplary construction of the ink-jet recording apparatus of the present teaching. As shown in FIG. 4, the ink-jet recording apparatus 1 includes, as main constitutive components, an ink cartridge assembly 2, an ink discharge mechanism (ink-jet head) 3, a head unit 4, a carriage 5, a driving unit 6, a platen roller 7, a purge apparatus 8, and a control mechanism (not shown).

The ink cartridge assembly 2 includes a treatment agent cartridge 2*a*, a bright pigment ink cartridge 2*b*, and four water-based pigment ink cartridges 2*c*. The treatment agent cartridge 2*a* contains the treatment agent for constructing the ink set of the present teaching. The bright pigment ink cartridge 2*b* contains the bright pigment ink for constructing the ink set of the present teaching. Each of the four water-based pigment ink cartridges 2*c* contains one color of each of four colors of water-based pigment inks of yellow, magenta, cyan, and black. The four colors of the water-based pigment inks are the water-based pigment inks for constructing the ink set of the present teaching.

The ink-jet head 3, which is installed for the head unit 4, performs the recording on the recording medium (for example, recording paper) P. The ink cartridge assembly 2 and the head unit 4 are carried on the carriage 5. The driving unit 6 reciprocatively moves the carriage 5 in the straight line direction. For example, those conventionally known can be used as the driving unit 6 (see, for example, Japanese Patent Application Laid-open No. 2008-246821 corresponding to United States Patent Application Publication No. 2008/0241398). The platen roller 7 extends in the reciprocating direction of the carriage 5, and the platen roller 7 is arranged opposingly to the ink-jet head 3.

The purge apparatus 8 sucks any defective ink containing, for example, bubbles accumulated in the ink-jet head 3. For example, those conventionally known can be used as the purge apparatus 8 (see, for example, Japanese Patent Application Laid-open No. 2008-246821 corresponding to United States Patent Application Publication No. 2008/0241398).

A wiper member 20 is arranged adjacently to the purge apparatus 8 on the platen roller 7 side of the purge apparatus 8. The wiper member 20 is formed to have a spatula-shaped form. The wiper member 20 wipes out the nozzle-formed surface of the ink-jet head 3 in accordance with the movement of the carriage 5. With reference to FIG. 4, a cap 18 covers a plurality of nozzles of the ink-jet head 3 which is to be returned to the reset position when the recording is completed, in order to prevent the treatment agent, the bright pigment ink, and the water-based pigment inks from being dried.

The control mechanism controls the ink-jet recording apparatus 1 so that the application of the treatment agent, the discharge of the bright pigment ink, and the discharge of the water-based pigment inks are performed in this order.

In the ink-jet recording apparatus 1 of this example, the ink cartridge assembly 2 is carried on one carriage 5 together with the head unit 4. However, the present teaching is not limited thereto. In the ink-jet recording apparatus 1, each of the cartridges of the ink cartridge assembly 2 may be carried on any carriage distinct from the head unit 4. Alternatively, it is also allowable that the respective cartridges of the ink cartridge assembly 2 are not carried on the carriage 5, and they are arranged and fixed in the ink-jet recording apparatus 1. In the embodiments as described above, for example, the respective cartridges of the ink cartridge assembly 2 are connected to the head unit 4 carried on the carriage 5, for example, by means of tubes or the like, and the treatment agent, the bright pigment ink, and the water-based pigment inks are supplied from the respective cartridges of the ink cartridge assembly 2 to the head unit 4.

The ink-jet recording, which is based on the use of the ink-jet recording apparatus 1, is carried out, for example, as follows. At first, the recording paper P is fed from a paper feed cassette (not shown) provided at a side portion or a lower portion of the ink-jet recording apparatus 1. The recording paper P is introduced into the space between the ink-jet head 3 and the platen roller 7. The treatment agent, which constitutes the ink set of the present teaching, is applied (discharged) onto the introduced recording paper P from the ink-jet head 3.

Subsequently, the bright pigment ink and the water-based pigment inks are discharged in this order from the ink-jet head 3 to the application portion of the recording paper P applied with the treatment agent, and the predetermined recording is performed. The time, which ranges from the discharge of the treatment agent to the discharge of the bright pigment ink and the water-based pigment inks, is not specifically limited. For example, it is appropriate that the discharge of the bright pigment ink and the water-based pigment inks is carried out within the same scanning as that for the discharge of the treatment agent. As described above, the treatment agent is blended with the inorganic fine particles. Therefore, for example, even when the regular paper or the matte paper, which has the low smoothness, is used as the recording paper P, it is possible to obtain a recorded matter in which the excellent brightness is provided and the unevenness and the blurring are suppressed. Furthermore, when the water-based pigment inks are discharged after the discharge of the bright pigment ink, it is thereby possible to obtain the brightness for all colors (full colors) while providing the satisfactory color reproducibility. Subsequently, the recording paper P after the recording is discharged from the ink-jet recording apparatus 1. A paper feed mechanism and a paper discharge mechanism for the recording paper P are omitted from the illustration in FIG. 4.

In the ink-jet recording apparatus 1 of this example, the ink-jet head 3 also serves as the treatment agent applying mechanism. However, the present teaching is not limited thereto. As described above, in the present teaching, the application of the treatment agent may be carried out in accordance with any system including, for example, the stamp application, the brush application, and the roller application.

In the apparatus shown in FIG. 4, the serial type ink-jet head is adopted. However, the present teaching is not limited thereto. The ink-jet recording apparatus may be an apparatus which adopts a line type ink-jet head.

As explained above, according to the recording method of the present teaching, the recording medium is firstly treated with the treatment agent containing the inorganic fine particles. After that, the bright pigment ink is discharged, and then the water-based pigment ink is discharged. Thus, the color reproducibility is satisfactory, and it is possible to obtain the brightness in relation to all colors (full colors).

EXAMPLES

Next, Examples of the present teaching will be explained together with Comparative Examples. The present teaching is not limited to and restricted by Examples and Comparative Examples described below.

Preparation of Treatment Agent

Respective components of treatment agent compositions (Table 1) were mixed uniformly or homogeneously to obtain treatment agents 1 to 12. Numerical values in Table 1 indicate the active ingredient amount (solid content amount).

Preparation of Bright Pigment Ink

Ink solvents were obtained by uniformly mixing components except for a bright pigment contained in bright pigment ink compositions (Table 2). Subsequently, the ink solvents were added to the bright pigment, followed by being uniformly mixed. After that, obtained mixtures were filtrated through a cellulose acetate type membrane filter produced by Toyo Roshi Kaisha, Ltd. (pore size: 3.00 μm), and thus bright pigment inks 1 to 5 were obtained. Numerical values in Table 2 indicate the active ingredient amount (solid content amount).

Preparation of Water-Based Pigment Ink

Ink solvents were obtained by uniformly mixing components except for the self-dispersible pigment contained in water-based ink compositions (Table 3). Subsequently, the ink solvents were added to self-dispersible pigments dispersed in water, followed by being uniformly mixed. After that, obtained mixtures were filtrated through a cellulose acetate type membrane filter produced by Toyo Roshi Kaisha, Ltd. (pore size: 3.00 μm), and thus water-based pigment inks Y1, Y2, M1, M2, C1, C2, and K1 were obtained. Numerical values in Table 3 indicate the active ingredient amount (solid content amount).

Table 1 (Following)—Legend

*1: Produced by Cabot Corporation; anionic; average particle size is 150 nm as measured by using dynamic light scattering type particle diameter distribution measuring apparatus "LB-550" produced by HORIBA, Ltd.

*2: Produced by Cabot Corporation; anionic; average particle size is 230 nm as measured by using dynamic light scattering type particle diameter distribution measuring apparatus "LB-550" produced by HORIBA, Ltd.

*3: Produced by Sanyo Chemical Industries, Ltd.; average particle size: 20 nm

*4: Produced by Sanyo Chemical Industries, Ltd.; average particle size: 70 nm

*5: Produced by Sanyo Chemical Industries, Ltd.; average particle size: 300 nm

*6: Acetylene glycol-based surfactant (ethylene oxide (10 mol) adduct of diol); produced by Nissin Chemical Industry Co., Ltd.; active ingredient=100%

*7: Sodium polyoxyethylene alkyl (C=12, 13) ether sulfate (3E.O.); produced by Lion Corporation; active ingredient amount: 28% by weight Table 3 (Following)—Legend

*10: Self-dispersible yellow pigment; produced by Cabot Corporation; average particle size 100 to 150 nm

*11: Self-dispersible yellow pigment; produced by Cabot Corporation; average particle size 100 to 150 nm

*12: Self-dispersible magenta pigment; produced by Cabot Corporation; average particle size 100 to 150 nm

TABLE 1

| | | Treatment agent (% by weight) | | | | | |
|---|---|---|---|---|---|---|---|
| | | 1 | 2 | 3 | 4 | 5 | 6 |
| Fumed silica (E) | CAB-O-SPERSE (trade name) PG002 (*1) | 15 | 8 | 24 | 20 | 6 | 26 |
| | CAB-O-SPERSE (trade name) PG001 (*2) | — | — | — | — | — | — |
| Urethane resin (F) | Ucoat (trade name) UWS-145 (*3) | 5 | 2 | 6 | — | 2 | 6 |
| | Permalin (trade name) UA-150 (*4) | — | — | — | 8 | — | — |
| | Permalin (trade name) UA-368 (*5) | — | — | — | — | — | — |
| Humectant | Glycerol | — | — | 5 | — | — | — |
| | Triethylene glycol | — | — | — | — | — | — |
| Penetrant | Triethylene glycol n-butyl ether | — | 1 | — | — | — | — |
| Surfactant | Olfine (trade name) E1010 (*6) | — | 0.5 | — | — | — | — |
| | Sunnol (trade name) NL-1430 (*7) | — | — | — | — | — | — |
| | Water | balance | balance | balance | balance | balance | balance |
| | E/F | 3.0 | 4.0 | 4.0 | 2.5 | 3.0 | 4.3 |
| | E + F (% by weight) | 20 | 10 | 30 | 28 | 8 | 32 |

| | | Treatment agent (% by weight) | | | | | |
|---|---|---|---|---|---|---|---|
| | | 7 | 8 | 9 | 10 | 11 | 12 |
| Fumed silica (E) | CAB-O-SPERSE (trade name) PG002 (*1) | 20 | 4 | 30 | 26 | — | 26 |
| | CAB-O-SPERSE (trade name) PG001 (*2) | — | — | — | — | 20 | — |
| Urethane resin (F) | Ucoat (trade name) UWS-145 (*3) | 9 | 1 | 6 | 13 | 9 | — |
| | Permalin (trade name) UA-150 (*4) | — | — | — | — | — | — |
| | Permalin (trade name) UA-368 (*5) | — | — | — | — | — | 6 |
| Humectant | Glycerol | — | — | — | — | — | — |
| | Triethylene glycol | — | — | — | 5 | — | — |
| Penetrant | Triethylene glycol n-butyl ether | 3 | — | — | — | — | — |
| Surfactant | Olfine (trade name) E1010 (*6) | — | — | 2 | — | — | — |
| | Sunnol (trade name) NL-1430 (*7) | — | 1 | — | — | — | — |
| | Water | balance | balance | balance | balance | balance | balance |
| | E/F | 2.2 | 4.0 | 5.0 | 2.0 | 2.2 | 4.3 |
| | E + F (% by weight) | 29 | 5 | 36 | 39 | 29 | 32 |

Table 2 (Following)—Legend

*8: Produced by Mitsubishi Materials Electronic Chemicals Co., Ltd.; average particle size: 20 nm

*6: Acetylene glycol-based surfactant (ethylene oxide (10 mol) adduct of diol); produced by Nissin Chemical Industry Co., Ltd.; active ingredient=100%

*7: Sodium polyoxyethylene alkyl (C=12, 13) ether sulfate (3E.O.); produced by Lion Corporation; active ingredient amount: 28% by weight

*9: Produced by Arch Chemicals

*13: Self-dispersible magenta pigment; produced by Cabot Corporation; average particle size 100 to 150 nm

*14: Self-dispersible cyan pigment; produced by Cabot Corporation; average particle size 100 to 150 nm

*15: Self-dispersible cyan pigment; produced by Cabot Corporation; average particle size 100 to 150 nm

*16: Self-dispersible black pigment; produced by Cabot Corporation; average particle size 100 to 150 nm

*6: Acetylene glycol-based surfactant (ethylene oxide (10 mol) adduct of diol); produced by Nissin Chemical Industry Co., Ltd.; active ingredient=100%

TABLE 2

| | | Bright pigment ink (% by weight) | | | | |
|---|---|---|---|---|---|---|
| | | 1 | 2 | 3 | 4 | 5 |
| Bright pigment | Silver nanocolloid H-1 (*8) | 1 | 2 | 4 | 10 | 12 |
| Humectant | Glycerol | 30 | 15 | 30 | 28 | 30 |
| | Triethylene glycol | — | 15 | — | — | — |
| Penetrant | Triethylene glycol n-butyl ether | — | — | — | 2 | — |
| Surfactant | Olfine (trade name) E1010 (*6) | — | 0.5 | 1 | 1 | 2 |
| | Sunnol (trade name) NL-1430 (*7) | 1 | — | — | — | — |
| fungicide | Proxel GXL(S) (*9) | 0.1 | 0.1 | 0.1 | 0.1 | 0.1 |
| | Water | balance | balance | balance | balance | balance |

*7: Sodium polyoxyethylene alkyl (C=12, 13) ether sulfate (3E.O.); produced by Lion Corporation; active ingredient amount: 28% by weight

*9: Produced by Arch Chemicals

TABLE 3

| | | Water-based pigment ink (% by weight) | | | | | | |
|---|---|---|---|---|---|---|---|---|
| | | Y1 | Y2 | M1 | M2 | C1 | C2 | K1 |
| Pigment | CAB-O-JET (trade name) 270Y (*10) | 5 | — | — | — | — | — | — |
| | CAB-O-JET (trade name) 470Y (*11) | — | 4 | — | — | — | — | — |
| | CAB-O-JET (trade name) 260M (*12) | — | — | 5 | — | — | — | — |
| | CAB-O-JET (trade name) 465M (*13) | — | — | — | 6 | — | — | — |
| | CAB-O-JET (trade name) 250C (*14) | — | — | — | — | 4 | — | — |
| | CAB-O-JET (trade name) 450C (*15) | — | — | — | — | — | 5 | — |
| | CAB-O-JET (trade name) 400 (*16) | — | — | — | — | — | — | 7 |
| Humectant | Glycerol | 25 | 22 | 25 | 20 | 26 | 21 | 22 |
| | Triethylene glycol | — | 10 | — | 10 | — | 10 | — |
| Penetrant | Triethylene glycol n-butyl ether | 3 | — | 3 | — | 3 | — | 3 |
| | 1,2-Hexanediol | — | 5 | — | 5 | — | 5 | — |
| Surfactant | Olfine (trade name) E1010 (*6) | 0.5 | 0.5 | 0.5 | 0.5 | 0.5 | 0.5 | 0.5 |
| | Sunnol (trade name) NL-1430 (*7) | 1 | — | 1 | — | 1 | — | 1 |
| fungicide | Proxel GXL(S) (*9) | 0.1 | 0.1 | 0.1 | 0.1 | 0.1 | 0.1 | 0.1 |
| | Water | balance | balance | balance | balance | balance | balance | balance |

Examples 1 to 25

The treatment agent shown in Table 4 was applied onto matte paper (BP60MA produced by Brother Industries, Ltd.) by using a bar coater (Rod No. 3 of a bar coater produced by Yasuda Seiki Seisakusho Ltd.). Subsequently, the bright pigment ink and the water-based pigment ink shown in Table 4 were discharged in this order by using an ink-jet printer MFC-J4510N produced by Brother Industries, Ltd. to record an image having a resolution of 600 dpi×2400 dpi on the matte paper, and thus an evaluation sample was prepared. Table 4 shows Duty in the bright pigment ink discharge step and the water-based pigment ink discharge step.

Comparative Examples 1 to 3

The treatment agent shown in Table 4 was applied onto matte paper (BP60MA produced by Brother Industries, Ltd.) by using a bar coater (Rod No. 3 of a bar coater produced by Yasuda Seiki Seisakusho Ltd.). Subsequently, the water-based pigment ink and the bright pigment ink shown in Table 4 were discharged in this order by using an ink-jet printer MFC-J4510N produced by Brother Industries, Ltd. to record an image having a resolution of 600 dpi×2400 dpi on the matte paper, and thus an evaluation sample was prepared. Table 4 shows Duty in the water-based pigment ink discharge step and the bright pigment ink discharge step.

Comparative Example 4

The bright pigment ink shown in Table 4 was discharged onto matte paper (BP60MA produced by Brother Industries, Ltd.) by using an ink-jet printer MFC-J4510N produced by Brother Industries, Ltd. Subsequently, the treatment agent shown in Table 4 was applied onto the matte paper by using a bar coater (Rod No. 3 of a bar coater produced by Yasuda Seiki Seisakusho Ltd.). Subsequently, the water-based pigment ink shown in Table 4 was discharged by using the ink-jet printer MFC-J4510N to record an image having a resolution of 600 dpi×2400 dpi on the matte paper, and thus an evaluation sample was prepared. Table 4 shows Duty in the bright pigment ink discharge step and the water-based pigment ink discharge step.

Comparative Example 5

The water-based pigment ink shown in Table 4 was discharged onto matte paper (BP60MA produced by Brother Industries, Ltd.) by using an ink-jet printer MFC-J4510N produced by Brother Industries, Ltd. Subsequently, the treatment agent shown in Table 4 was applied onto the matte paper by using a bar coater (Rod No. 3 of a bar coater produced by Yasuda Seiki Seisakusho Ltd.). Subsequently, the bright pigment ink shown in Table 4 was discharged by using the ink-jet printer MFC-J4510N to record an image having a resolution of 600 dpi×2400 dpi on the matte paper, and thus an evaluation sample was prepared. Table 4 shows Duty in the water-based pigment ink discharge step and the bright pigment ink discharge step.

Comparative Example 6

The bright pigment ink and the water-based pigment ink shown in Table 4 were discharged in this order onto matte paper (BP60MA produced by Brother Industries, Ltd.) by using an ink-jet printer MFC-J4510N produced by Brother Industries, Ltd. Subsequently, the treatment agent shown in Table 4 was applied onto the matte paper by using a bar coater (Rod No. 3 of a bar coater produced by Yasuda Seiki Seisakusho Ltd.), and thus an evaluation sample was prepared. Table 4 shows Duty in the bright pigment ink discharge step and the water-based pigment ink discharge step.

Comparative Example 7

The water-based pigment ink and the bright pigment ink shown in Table 4 were discharged in this order onto matte paper (BP60MA produced by Brother Industries, Ltd.) by using an ink-jet printer MFC-J4510N produced by Brother Industries, Ltd. Subsequently, the treatment agent shown in Table 4 was applied onto the matte paper by using a bar coater (Rod No. 3 of a bar coater produced by Yasuda Seiki Seisakusho Ltd.), and thus an evaluation sample was prepared. Table 4 shows Duty in the water-based pigment ink discharge step and the bright pigment ink discharge step.

In relation to Examples 1 to 25 and Comparative Examples 1 to 7, (a) the evaluation of the brightness of the recorded portion, (b) the evaluation of the image quality (unevenness and blurring) of the recorded portion, (c) the evaluation of the fixation performance of the recorded portion, (d) the evaluation of the color reproducibility, and (e) the overall evaluation were carried out in accordance with the following methods.

(a) Evaluation of Brightness of Recorded Portion

The solid printing portion of the evaluation sample was observed visually, and the brightness of the image was evaluated in accordance with the following evaluation criteria.

Evaluation Criteria for Evaluation of Brightness of Recorded Portion

AA: Sufficient brightness was provided.

A: Brightness was slightly inferior.

B: Brightness was somewhat inferior, which was at such a level that no problem was caused practically.

C: Brightness was not provided, which was at such a level that any problem was caused practically.

(b) Evaluation of Image Quality (Unevenness and Blurring) of Recorded Portion

The solid printing portion of the evaluation sample was observed visually, and the image quality was evaluated in accordance with the following evaluation criteria.

Evaluation Criteria for Evaluation of Image Quality (Unevenness and Blurring) of Recorded Portion AA: Neither unevenness nor blurring was observed.

A: Unevenness and blurring were slightly observed.

B: Unevenness and blurring were observed to some extent, which were at such a level that no problem was caused practically.

C: Unevenness and blurring were observed clearly, which were at such a level that any problem was caused practically.

(c) Evaluation of Fixation Performance of Recorded Portion

The solid printing portion of the evaluation sample was rubbed with a finger after the elapse of 30 seconds after the recording. The rubbing-off was observed visually for the bright pigment ink and the water-based pigment ink, and the fixation performance was evaluated in accordance with the following criteria.

Evaluation Criteria for Evaluation of Fixation Performance of Recorded Portion

AA: No rubbing-off of recorded portion was observed.

A: Rubbing-off of recorded portion was slightly observed.

B: Rubbing-off of recorded portion was observed to some extent, which was at such a level that no problem was caused practically.

C: Rubbing-off of recorded portion was observed clearly, which was at such a level that any problem was caused practically.

(d) Color Reproducibility

The solid printing portion of the evaluation sample was observed visually, and the color reproducibility was evaluated in accordance with the following evaluation criteria. The phrase "color reproducibility was provided" means the fact that the shade (tint or hue) of color, which was equivalent to that obtained when the bright pigment ink was not used, was obtained even when the water-based pigment ink was used together with the bright pigment ink. For example, if the yellow color is converted into the ocher color by using the water-based yellow pigment ink together with the bright pigment ink, the color reproducibility is not provided.

Evaluation Criteria for Evaluation of Color Reproducibility

AA: Sufficient color reproducibility was provided.

A: Color reproducibility was slightly inferior.

B: Color reproducibility was somewhat inferior, which was at such a level that no problem was caused practically.

C: Color reproducibility was not provided, which was at such a level that any problem was caused practically.

(e) Overall Evaluation

Overall evaluation was performed in accordance with the following evaluation criteria from the results of (a) to (d) described above.

Evaluation Criteria for Overall Evaluation

G: All of the results of (a) to (d) were AA, A, or B.

NG: Any one of the results of (a) to (d) was C.

Table 4 shows evaluation results of Examples 1 to 25 and Comparative Examples 1 to 7.

TABLE 4

| | | Example | | | | | | | | | | | | |
|---|---|---|---|---|---|---|---|---|---|---|---|---|---|---|
| | | 1 | 2 | 3 | 4 | 5 | 6 | 7 | 8 | 9 | 10 | 11 | 12 | 13 |
| Treatment agent | | 1 | 1 | 1 | 1 | 1 | 1 | 2 | 3 | 4 | 5 | 6 | 7 | 8 |
| E/F | | 3.0 | 3.0 | 3.0 | 3.0 | 3.0 | 3.0 | 4.0 | 4.0 | 2.5 | 3.0 | 4.3 | 2.2 | 4.0 |
| E + F (% by weight) | | 20 | 20 | 20 | 20 | 20 | 20 | 10 | 30 | 28 | 8 | 32 | 29 | 5 |
| Bright pigment ink | | 1 | 2 | 3 | 4 | 5 | 3 | 3 | 3 | 3 | 3 | 3 | 3 | 3 |
| (A) Bright pigment ratio (% by weight) | | 1 | 2 | 4 | 10 | 12 | 4 | 4 | 4 | 4 | 4 | 4 | 4 | 4 |
| (B) Duty (%) | | 100 | 100 | 70 | 50 | 60 | 100 | 60 | 70 | 100 | 60 | 70 | 100 | 60 |
| (A × B)/100 | | 1.0 | 2.0 | 2.8 | 5.0 | 7.2 | 4.0 | 2.4 | 2.8 | 4.0 | 2.4 | 2.8 | 4.0 | 2.4 |
| Water-based pigment ink | | Y1 | M1 | C1 | Y2 | M2 | C2 | K1 | Y1 | M1 | C1 | Y2 | M2 | C2 |
| (C) Pigment ratio (% by weight) | | 5 | 5 | 4 | 4 | 6 | 5 | 7 | 5 | 5 | 4 | 4 | 6 | 5 |
| (D) Duty (%) | | 50 | 90 | 90 | 100 | 90 | 90 | 60 | 90 | 60 | 50 | 70 | 60 | 70 |
| (C × D)/100 | | 2.5 | 4.5 | 3.6 | 4.0 | 5.4 | 4.5 | 4.2 | 4.5 | 3.0 | 2.0 | 2.8 | 3.6 | 3.5 |
| Evaluation result | Brightness of recorded portion | A | AA | AA | AA | AA | AA | AA | AA | AA | A | AA | AA | A |
| | Image quality of recorded portion (unevenness and blurring) | AA | AA | AA | AA | AA | AA | AA | AA | AA | AA | A | A | AA |
| | Fixation performance of recorded portion | AA | AA | AA | AA | A | AA | AA | AA | AA | AA | A | AA | AA |
| | Color reproducibility | A | A | AA | AA | A | A | A | A | AA | A | AA | AA | A |
| | Overall evaluation | G | G | G | G | G | G | G | G | G | G | G | G | G |

TABLE 4-continued

| | | Example | | | | | | | | | | | |
|---|---|---|---|---|---|---|---|---|---|---|---|---|---|
| | | 14 | 15 | 16 | 17 | 18 | 19 | 20 | 21 | 22 | 23 | 24 | 25 |
| Treatment agent | | 9 | 10 | 11 | 12 | 1 | 1 | 1 | 1 | 1 | 1 | 3 | 5 |
| E/F | | 5.0 | 2.0 | 2.2 | 4.3 | 3.0 | 3.0 | 3.0 | 3.0 | 3.0 | 3.0 | 4.0 | 3.0 |
| E + F (% by weight) | | 36 | 39 | 29 | 32 | 20 | 20 | 20 | 20 | 20 | 20 | 30 | 8 |
| Bright pigment ink | | 3 | 3 | 4 | 5 | 1 | 2 | 3 | 4 | 5 | 3 | 3 | 3 |
| (A) Bright pigment ratio (% by weight) | | 4 | 4 | 10 | 12 | 1 | 2 | 4 | 10 | 12 | 4 | 4 | 4 |
| (B) Duty (%) | | 70 | 100 | 80 | 90 | 70 | 30 | 20 | 50 | 100 | 70 | 20 | 20 |
| (A × B)/100 | | 2.8 | 4.0 | 8.0 | 10.8 | 0.7 | 0.6 | 0.8 | 5.0 | 12.0 | 2.8 | 0.8 | 0.8 |
| Water-based pigment ink | | K1 | Y1 | M1 | C1 | Y1 | M1 | C1 | K1 | Y2 | M2 | C2 | K1 |
| (C) Pigment ratio (% by weight) | | 7 | 5 | 5 | 4 | 5 | 5 | 4 | 7 | 4 | 6 | 5 | 7 |
| (D) Duty (%) | | 50 | 70 | 60 | 50 | 50 | 90 | 90 | 90 | 100 | 100 | 100 | 50 |
| (C × D)/100 | | 3.5 | 3.5 | 3.0 | 2.0 | 2.5 | 4.5 | 3.6 | 6.3 | 4.0 | 6.0 | 5.0 | 3.5 |
| Evaluation result | Brightness of recorded portion | AA | AA | A | A | A | AA | AA | AA | AA | AA | AA | A |
| | Image quality of recorded portion (unevenness and blurring) | A | A | A | A | AA | AA | AA | AA | AA | AA | AA | AA |
| | Fixation performance of recorded portion | A | AA | AA | A | AA | AA | AA | AA | A | AA | AA | A |
| | Color reproducibility | AA | AA | A | A | B | B | B | B | B | B | B | B |
| | Overall evaluation | G | G | G | G | G | G | G | G | G | G | G | G |

| | | Comparative Example | | | | | | |
|---|---|---|---|---|---|---|---|---|
| | | 1 | 2 | 3 | 4 | 5 | 6 | 7 |
| Treatment agent | | 1 | 1 | 1 | 7 | 9 | 7 | 9 |
| E/F | | 3.0 | 3.0 | 3.0 | 2.2 | 5.0 | 2.2 | 5.0 |
| E + F (% by weight) | | 20 | 20 | 20 | 29 | 36 | 29 | 36 |
| Bright pigment ink | | 1 | 2 | 3 | 3 | 3 | 3 | 3 |
| (A) Bright pigment ratio (% by weight) | | 1 | 2 | 4 | 4 | 4 | 4 | 4 |
| (B) Duty (%) | | 100 | 100 | 70 | 100 | 70 | 100 | 70 |
| (A × B)/100 | | 1.0 | 2.0 | 2.8 | 4.0 | 2.8 | 4.0 | 2.8 |
| Water-based pigment ink | | Y1 | M1 | C1 | M2 | K1 | M2 | K1 |
| (C) Pigment ratio (% by weight) | | 5 | 5 | 4 | 6 | 7 | 6 | 7 |
| (D) Duty (%) | | 50 | 90 | 90 | 60 | 50 | 60 | 50 |
| (C × D)/100 | | 2.5 | 4.5 | 3.6 | 3.6 | 3.5 | 3.6 | 3.5 |
| Evaluation result | Brightness of recorded portion | A | AA | AA | C | AA | C | C |
| | Image quality of recorded portion (unevenness and blurring) | AA | AA | AA | C | A | C | C |
| | Fixation performance of recorded portion | AA | AA | AA | AA | A | AA | A |
| | Color reproducibility | C | C | C | AA | C | C | C |
| | Overall evaluation | NG | NG | NG | NG | NG | NG | NG |

As shown in Table 4, in Examples 1 to 25, the evaluation results were satisfactory for all of the brightness of the recorded portion, the image quality (unevenness and blurring) of the recorded portion, the fixation performance of the recorded portion, and the color reproducibility. In particular, in Examples 3, 4, and 9 which fulfilled all of the conditions (X1), (Y1), (Z3), and (Z4), the evaluation results were extremely satisfactory for all of the brightness of the recorded portion, the image quality (unevenness and blurring) of the recorded portion, the fixation performance of the recorded portion, and the color reproducibility.

On the other hand, in Comparative Examples 1 to 3 in which the pretreatment step, the water-based pigment ink discharge step, and the bright pigment ink discharge step were performed in this order, the result of the evaluation of the color reproducibility was unsatisfactory. Furthermore, in Comparative Example 4 in which the bright pigment ink discharge step, the pretreatment step, and the water-based pigment ink discharge step were performed in this order, the results of the evaluation of the brightness of the recorded portion and the evaluation of the image quality (unevenness and blurring) of the recorded portion were unsatisfactory. Moreover, in Comparative Example 5 in which the water-based pigment ink discharge step, the pretreatment step, and the bright pigment ink discharge step were performed in this order, the result of the evaluation of the color reproducibility was unsatisfactory. Moreover, in Comparative Example 6 in which the bright pigment ink discharge step, the water-based pigment ink discharge step, and the pretreatment step were performed in this order, the results of the evaluation of the brightness of the recorded portion, the evaluation of the image quality (unevenness and blurring) of the recorded portion, and the evaluation of the color reproducibility were unsatisfactory. Moreover, also in Comparative Example 7 in which the water-based pigment ink discharge step, the bright pigment ink discharge step, and the pretreatment step were performed in this order, the results of the evaluation of the brightness of the recorded portion, the evaluation of the image quality (unevenness and blurring) of the recorded portion, and the evaluation of the color reproducibility were unsatisfactory.

As described above, according to the recording method of the present teaching, the excellent brightness is provided and the color reproducibility is excellent as well even in the case of the recording medium in which the smoothness is low. The way of use of the recording method of the present teaching is not specifically limited, and the recording method of the present teaching can be widely applied to various types of recording.

What is claimed is:

1. A recording method comprising:

applying, to a recording medium, a treatment agent containing inorganic fine particles;

discharging a bright pigment ink containing a bright pigment and water to a portion of the recording medium to which the treatment agent has been applied; and discharging a water-based pigment ink containing a pigment different from the bright pigment and water to the portion of the recording medium to which the bright pigment ink has been discharged.

2. The recording method according to claim 1, wherein the treatment agent or the bright pigment ink further contains a binder resin.

3. The recording method according to claim 2, wherein the binder resin is urethane resin.

4. The recording method according to claim 1, wherein the treatment agent further contains a binder resin.

5. The recording method according to claim 4, wherein the treatment agent fulfills following conditions (Z1) and (Z2):

$$2 \leq E/F \leq 5 \quad \text{(Z1)}$$

$$5 \leq E+F \leq 40 \quad \text{(Z2)}$$

E: blending amount (% by weight) of the inorganic fine particles contained in the treatment agent;

F: blending amount (% by weight) of the binder resin contained in the treatment agent.

6. The recording method according to claim 4, wherein the treatment agent fulfills following conditions (Z3) and (Z4):

$$2.5 \leq E/F \leq 4 \quad \text{(Z3)}$$

$$10 \leq E+F \leq 30 \quad \text{(Z4)}$$

E: blending amount (% by weight) of the inorganic fine particles contained in the treatment agent;

F: blending amount (% by weight) of the binder resin contained in the treatment agent.

7. The recording method according to claim 4, wherein:

the binder resin is a urethane resin;

the inorganic fine particles are fumed silica; and the following conditions (X1), (Y1), (Z3), and (Z4) are fulfilled:

$$2.5 \leq (A \times B)/100 \leq 7.5 \quad \text{(X1)}$$

$$(C \times D)/100 \leq 4.0 \quad \text{(Y1)}$$

$$2.5 \leq E/F \leq 4 \quad \text{(Z3)}$$

$$10 \leq E+F \leq 30 \quad \text{(Z4)}$$

A: blending amount (% by weight) of the bright pigment contained in the bright pigment ink;

B: Duty (%) of the bright pigment ink upon discharge of the bright pigment ink;

C: blending amount (% by weight) of the pigment contained in the water-based pigment ink;

D: Duty (%) of the water-based pigment ink upon discharge of the water-based pigment ink;

E: blending amount (% by weight) of the inorganic fine particles contained in the treatment agent;

F: blending amount (% by weight) of the binder resin contained in the treatment agent.

8. The recording method according to claim 1, wherein the inorganic fine particles are fumed silica.

9. The recording method according to claim 1, wherein the recording method fulfills following conditions (X) and (Y):

$$1.0 \leq (A \times B)/100 \leq 11 \quad \text{(X)}$$

$$(C \times D)/100 \leq 5.5 \quad \text{(Y)}$$

A: blending amount (% by weight) of the bright pigment contained in the bright pigment ink;

B: Duty (%) of the bright pigment ink upon discharge of the bright pigment ink;

C: blending amount (% by weight) of the pigment contained in the water-based pigment ink;

D: Duty (%) of the water-based pigment ink upon discharge of the water-based pigment ink.

10. The recording method according to claim 1, wherein the recording method fulfills following conditions (X1) and (Y1):

$$2.5 \leq (A \times B)/100 \leq 7.5 \quad \text{(X1)}$$

$$(C \times D)/100 \leq 4.0 \quad \text{(Y1)}$$

A: blending amount (% by weight) of the bright pigment contained in the bright pigment ink;

B: Duty (%) of the bright pigment ink upon discharge of the bright pigment ink;

C: blending amount (% by weight) of the pigment contained in the water-based pigment ink;

D: Duty (%) of the water-based pigment ink upon discharge of the water-based pigment ink.

11. The recording method according to claim 1, wherein the bright pigment is silver particles or aluminum particles.

12. The recording method according to claim 1, wherein the bright pigment is silver particles.

13. The recording method according to claim 1, wherein the bright pigment is contained in the bright pigment ink by not more than 12% by weight.

14. The recording method according to claim 1, wherein the bright pigment is contained in the bright pigment ink by not more than 10% by weight.

15. The recording method according to claim 1, wherein an average particle size of the inorganic fine particles is not more than 250 nm.

16. The recording method according to claim 1, wherein the treatment agent further contains a urethane emulsion.

17. The recording method according to claim 16, wherein an average particle size of urethane resin particles contained in the urethane emulsion is not more than 300 nm.

18. The recording method according to claim 1, wherein an average particle size of the pigment different from the bright pigment is larger than an average particle size of the bright pigment.

19. The recording method according to claim 1, wherein:

the treatment agent further contains a binder emulsion; and an average particle size of binder resin particles contained in the binder emulsion is smaller than an average particle size of the inorganic fine particles.

20. The recording method according to claim 1, wherein a pretreatment layer is formed on the recording medium by applying the treatment agent to the recording medium, and a thickness of the pretreatment layer is 0.1 μm to 20 μm.

* * * * *